United States Patent [19]

Rullier

[11] Patent Number: 4,984,816

[45] Date of Patent: Jan. 15, 1991

[54] SAFETY BINDING

[75] Inventor: Pierre Rullier, Annecy, France

[73] Assignee: Salomon S.A., Annecy Cedex, France

[21] Appl. No.: 281,208

[22] Filed: Dec. 8, 1988

[30] Foreign Application Priority Data

Dec. 9, 1987 [FR] France ..... 87-17152

[51] Int. Cl.[5] ..... A67C 9/08

[52] U.S. Cl. ..... 280/625; 280/634; 280/636

[58] Field of Search ..... 280/634, 636, 625, 626, 280/628

[56] References Cited

U.S. PATENT DOCUMENTS

| | | | |
|---|---|---|---|
| 4,336,956 | 6/1982 | Richert et al. | 280/625 |
| 4,365,822 | 12/1982 | Nitschko et al. | 280/625 |
| 4,434,997 | 3/1984 | Nitschko | 280/625 |
| 4,538,828 | 9/1985 | Dimier | 280/628 |
| 4,561,673 | 12/1985 | Pascal et al. | 280/629 |
| 4,784,404 | 11/1988 | Kowatsch | 280/634 |

FOREIGN PATENT DOCUMENTS

| | | | |
|---|---|---|---|
| 2905837 | 8/1980 | Fed. Rep. of Germany | 280/625 |
| 2366249 | 2/1983 | Fed. Rep. of Germany | 280/625 |
| 2179183 | 11/1973 | France | 280/625 |
| 2523857 | 9/1983 | France | 280/628 |
| 2537442 | 6/1984 | France | 280/629 |

*Primary Examiner*—David M. Mitchell

*Attorney, Agent, or Firm*—Sandler, Greenblum & Bernstein

[57] ABSTRACT

A binding for releasably securing an end of a ski boot to a ski including a body having a jaw for engaging a portion of the end of the boot, wherein the jaw includes a pair of wings mounted for lateral movement from an engagement position to a release position in response to the application of a release threshold force of a predetermined magnitude laterally against the jaw. The body is further mounted for movement in a direction substantially perpendicular to the lateral movement. An energization device is included for biasing the jaw toward the engagement position, against which the threshold force is applied to move the jaw from the engagement position to the release position. The binding further includes an assembly responsive to lateral movement of the end of said boot for applying a force against the energization device. The assembly is responsive to non-lateral movement of the end of the boot for applying a force against the energization device, wherein for a given increment of movement of the energization device by non-lateral movement of the end of the boot, the amount by which the lateral movement of the end of the boot is required for movement of the jaw to the release position is reduced by a substantially corresponding increment.

23 Claims, 3 Drawing Sheets

SAFETY BINDING

BACKGROUND OF THE INVENTION

1. Field of the Invention

The present invention relates to a safety binding for a ski adapted to releasably maintain an end, preferably the front end, of a boot mounted on the ski.

2. Description of Background and Relevant Information

Safety bindings for skis known as "front abutments" are known to include a body mounted on a base affixed to the ski. The body of the binding carries, at its rear portion, a retention jaw for the boot which includes two opposed lateral retention wings and an energization mechanism positioned within the body to elastically return the jaw to the engagement position with the boot. The energization mechanism includes a compressed energy spring which is supported at one end on a support surface connected to the body and, at its other end, on a force transmission element which is longitudinally movable in the body and coupled to the jaw in a manner so as to elastically bias the jaw against the front of the boot to ensure the retention of the boot on the ski.

Front abutments of the type described above are disclosed, for example, in French Patents 2,179,183, 2,523,857 and German Patentschrift 2,366,249.

The front abutment described in French Patent 2,179,183 includes a retention jaw which is constituted by two independent wings, journalled around respective axes and cooperating through their front or inner ends with the end portion of a rod slidably longitudinally mounted and biased by a spring forming a portion of the energization mechanism.

It is likewise known, as described in French Pat. No. 2,523,857, to provide a front abutment including a support pedal for the sole of the boot which senses a frontward fall, reacting to a downward bias. In such a front abutment, the jaw is journalled around a horizontal and transverse axis and it pivots upwardly as a result of an upward vertical bias, i e , in the case of a rearward fall of the skier.

The front abutment which is described in German Patentsscrift No. 2,366,249 is likewise of the type having independent lateral retention wings journalled around respective axes, and it includes a sole grip which is vertically movable and whose vertical upward movement in the case of a rearward fall of the skier causes a compression of the spring of the energization mechanism, i.e., a softening of the stiffness of the binding. That is, the force required for the lateral release of the front abutment is reduced.

SUMMARY OF THE INVENTION

The present invention is directed to a safety binding for releasably maintaining a front portion of a boot mounted on a ski, including a body mounted on a base which is affixed to the ski. The body includes a retention jaw in a rear portion thereof, the retention jaw including a sole-grip and two opposed lateral retention wings and having an engagement position The binding further includes an energization mechanism positioned in the body to elastically return the jaw to the engagement position upon movement away from the engagement position, the energization mechanism including an energy spring supported, at one end, on a support surface connected to the body and, at another end, on a force transmission element which is movable for longitudinal displacement in the body and coupled to the in a manner so as to elastically bias the jaw against the front portion of the boot to ensure the retention of the boot on the ski. The body is pivotably mounted on the base in a front portion of the base around a substantially horizontal and transverse axis, and the force transmission element which is coupled to the jaw is connected to an upper end of a rigid linkage element which is journalled at its lower end of the ski around a substantially horizontal and transverse axis and which is arranged in a manner such that a rocking movement of the body upwardly, around the substantially horizontal and transverse axis translates into an additional displacement of the force transmission element in a direction corresponding to an additional bias of the energy spring.

According to a further aspect of the invention, the spring is a compression spring, and the force transmission element is constituted by a longitudinal rod which is biased frontwardly by the energy spring supported, on the one hand, on a rear transverse end of an opening of the body containing the spring and, on the other hand, on a cap fixed to a front end of the rod. The upper end of the linkage element is connected to a head of the rod and is inclined, in the engagement position, from bottom to top and rear to front such that its axis for linkage with the head of the rod is positioned in a vertical plane between vertical planes containing, respectively, the transverse axis of the linkage element on the base and the transverse axis of the body on the base.

According to a further aspect of the invention, the jaw includes two lateral retention wings which are respectively journalled on the body around vertical axes, each lateral retention wing having portions substantially forming an obtuse angle and including a front arm of relatively short length, for contacting a front surface of the head of the rod, and a rear arm laterally inclined from the interior towards the exterior and from the front towards the rear.

According to one embodiment of the invention, the jaw is of a single piece having two lateral wings, the single piece jaw being connected to the rear end of the rod by means of a link which is substantially logitudinally and horizontally positioned, and which is journalled, at its front end, around a substantially vertical axis on the head of the rod.

The invention further includes a rocker having a front portion with two arms, the two arms being inclined from bottom to top and rear to front and being connected to the head of the rod. Further, the upper portions of the two arms of the rocker are connected to the head of the rod through a substantially horizontal and transverse journal axis constituting a two-way linkage apparatus.

Further according to an embodiment of the invention, the upper and front portions of the two arms of the rocker each have a ramp in contact, from the bottom, with a spur affixed to the head of the rod and, further, a connecting link inclined from bottom to top and from rear to front journalled, at its lower end, around the pivot axis of the rocker and, at its upper end, on the head of the rod around a substantially horizontal and transverse axis.

According to a further aspect of the invention, the rocker includes, in addition to the inclined arms, a horizontal arm extending towards the front, having a substantially longitudinal and horizontal slot in which is engaged a spur affixed to the rocker body, and each the inclined arm has, at an upper end portion, a vertical slot in which a spur is engaged affixed to the head of the rod.

According to a still further aspect of the invention, the rocker includes an activation flap extending towards the rear and which is horizontal or slightly inclined from bottom to top and from front to rear in a rest position, and on the activation flap rests the front end of a pedal, forming a frontward fall sensor, which is journalled around a substantially horizontal and transverse axis.

According to a still further aspect of the invention, the force transmission element is constituted by a piston which is longitudinally slidably positioned in an opening of the body and which is pushed towards the rear by the energy spring supported, at a rear end, on the piston and, at a front end, on a support surface affixed to a front portion of the body, wherein the upper end of the linkage element is connected to the piston and the linkage element is inclined from bottom to top and from front to rear such that its journal axis on the base is situated in a vertical plane between vertical planes containing, respectively, a linkage axis with the piston and the transverse journal axis of the body on the base.

According to a still further aspect of the invention, the jaw includes two lateral retention wings which are journalled on the body around respective vertical axes and each the wing having a transverse front surface which is in contact with a transverse projection of the piston in a manner so as to push the projection and the piston frontwardly when each the wing is itself pushed towards the exterior of the ski.

According to a still further aspect of the invention, a pusher having a generally square shape is disclosed as and being longitudinally slidably mounted under the rear portion of the body, the pusher including a substantially horizontal arm extending towards the rear and ending in a rear surface forming a ramp which is inclined from bottom to top and from rear to front and on which is supported the front end of a pedal, forming a frontward fall sensor, which is journalled around a substantially horizontal and transverse axis, the pusher including, in a front portion, a substantially vertical arm which extends upwardly and which engages in an opening provided in a lower portion of the piston by being in contact with a rear, substantially vertical surface of the piston, so as to push the piston frontwardly in response to a frontward fall.

According to a still further aspect of the invention, the linkage element is constituted by links which are connected to the piston by means of a two-way linkage apparatus.

The invention can also be defined as a binding for releasably securing an end of a boot of a skier to a ski including means for engaging a portion of the end of the boot, wherein the engaging means is mounted for lateral movement from an engagement position to a release position in response to the application of a release threshold force of a predetermined magnitude laterally against the engaging means; means responsive to either a frontward fall or a rearward fall of the skier for reducing the predetermined magnitude of the release threshold force required for moving the engaging means laterally to the release position wherein the fall responsive means includes means for pivotally mounting the engaging means about a forward portion therof.

The invention further includes means for elastically biasing the engaging means toward the engagement position and against which the application of a release threshold force acts for moving the engaging means to the release position wherein the fall responsive means includes means for transmitting movement of the boot to the elastically biasing means.

According to a further aspect of the invention, the means for transmitting movement is movable from a first position to a second position corresponding, respectively, to the engagement position and the release position of the engaging means wherein, in the second position, the transmitting means transmits a force against the elastically biasing means at least equal to the release threshold force, and wherein, in response to only other the frontward fall or only the rearward fall, the transmitting means transmits a force against the elastically biasing means less than the release threshold force.

According to a still further aspect of the invention, means are provided for permitting movement of the engaging means in a direction away from the ski, wherein the transmitting means transmits a force against the elastically biasing means less than the release threshold force in response to movement of the engaging means in a direction away from the ski.

According to a still further aspect of the invention, the engaging means is movable in the direction away from the ski in response to movement of the boot, preferably directly against the engaging means.

According to a still further aspect of the invention, the engaging means is movable in the direction away from the ski in response to movement of the end of the boot in a direction toward the ski.

The invention further includes means for linking the movement of the end of the boot toward the ski to the transmitting means.

The binding is preferably a front binding.

According to one embodiment of the invention, the engaging means includes a jaw having a pair of arms that move relative to each other.

According to another embodiment of the invention, the engaging means includes a jaw having a pair of arms that are fixed relative to each other.

According to a further aspect of the invention, the engaging means are mounted for lateral movement without movement away from the ski in response to only lateral movement of the end of the boot.

According to a still further aspect of the invention, the pivotally mounted means includes means for mounting the engaging means for non-lateral movement in response to only movement of the end of the boot other than lateral movement.

According to a still further aspect of the invention, the fall responsive means includes means for linking the lateral movement mounting means for respective independent application of a force by the end of the boot, via the transmitting means, against the elastic biasing means.

The invention can further be defined as a binding for releasably securing an end of a boot of a skier to a ski including a body including means for engaging a portion of the end of the boot, wherein the engaging means is mounted for lateral movement from an engagement position to a release position in response to the application of a release threshold force of a predetermined magnitude laterally against the engaging means, and wherein the body is further mounted for movement in a direction substantially perpendicular to the direction of the lateral movement. Means are provided for elastically biasing the engaging means toward the engagement position, against which the threshold force is applied to move the engaging means from the engagement position to the release position. Further, means are provided responsive to lateral movement of the end of the boot for applying a force against the elastically biasing means and for including the elastically biasing means. Still further, means are provided responsive to non-lateral movement of the end of the boot for applying a force against the elastically biasing means for including the elastically biasing means. For a given increment of biasing of the elastically biasing means by the non-lateral movement of the end of the boot, the amount by which the lateral movement of the end of the boot is required to be biased for movement of the engaging means to the release position is reduced by a substantially corresponding increment.

According to the invention, an axis is provided substantially transverse to the longitudinal axis of the ski about which the body is mounted for pivotal movement substantially perpendicular to the lateral movement.

Further according to the invention, a force transmitting member is provided operatively associated with the elastically biasing means and each of the lateral and non-lateral movement responsive means.

Further, lateral movement responsive means is fixed for movement with the engaging means. Further, the engaging means includes a jaw having a pair of arms, and wherein the lateral movement responsive means includes a further arm connected to each respective arm for directly engaging a member fixed relative to the transmitting member.

Still further according to the invention, the non-lateral movement responsive means includes means for directly engaging a member fixed relative to the transmitting member. The directly engaging means includes a rigid linkage element journalled at one end relative to the transmitting member, and journalled at another end about an axis adapted to be fixed relative to the ski. Further, the linkage element is configured and arranged to apply a force to the transmitting member in response to movement of the end of the boot both toward and away from the ski.

BRIEF DESCRIPTION OF THE DRAWINGS

The invention will now be described by way of non-limiting example with reference to various embodiments of the present invention, in connection with the annexed drawings in which.

DESCRIPTION OF PREFERRED EMBODIMENTS

The present invention relates to improvements to the above types of safety bindings or front abutments with the object of improving their reliability and particularly their sensitivity to release due to a lateral bias, combined with a frontward or rearward fall of the skier. Further, this is accomplished by a relatively simple but effective means.

To this end, the safety binding according to the present invention is adapted to maintain the front of a boot releasably mounted on a ski and includes a body mounted on a base affixed to the ski. The body of the binding carries, at its rear portion, a retention jaw for the boot, which includes a sole grip and two laterally opposed retention wings, and an energization mechanism positioned in the body to elastically return the jaw to the engagement position. The energization mechanism includes an energy spring supported at one end on a support surface connected to the body and, at its other end, on a longitudinally movable force transmission element located within the body and coupled to the jaw in a manner so as to elastically bias the jaw against the front of the boot to ensure its retention on the ski. The binding is characterized in that the body is pivotably mounted on the base, proximate its front portion, around a substantially horizontal and transverse axis, and the transmission element for the force which is coupled to the jaw is connected to the upper end of a rigid linkage element which is journalled at its lower end on the ski around a substantially horizontal and transverse axis, and which is positioned in a manner such that an upward pivoting movement of the body around the substantially horizontal and transverse axis translates into an additional displacement of the force transmission element in the direction corresponding to an additional bias of the energy spring.

Figure 1:
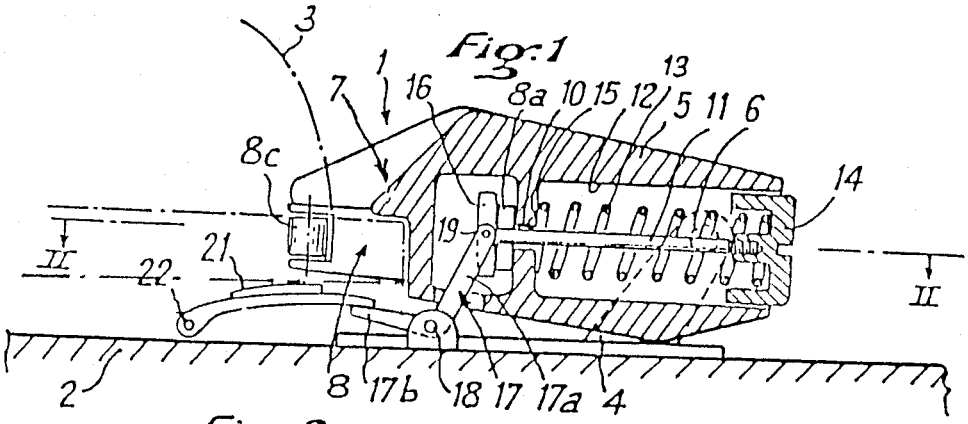
FIG. 1 is a vertical and longitudinal cross-sectional view of a front abutment according to the invention, in the engagement position, the jaw of the front abutment comprising two independent journalled retention wings.
Figure 2:
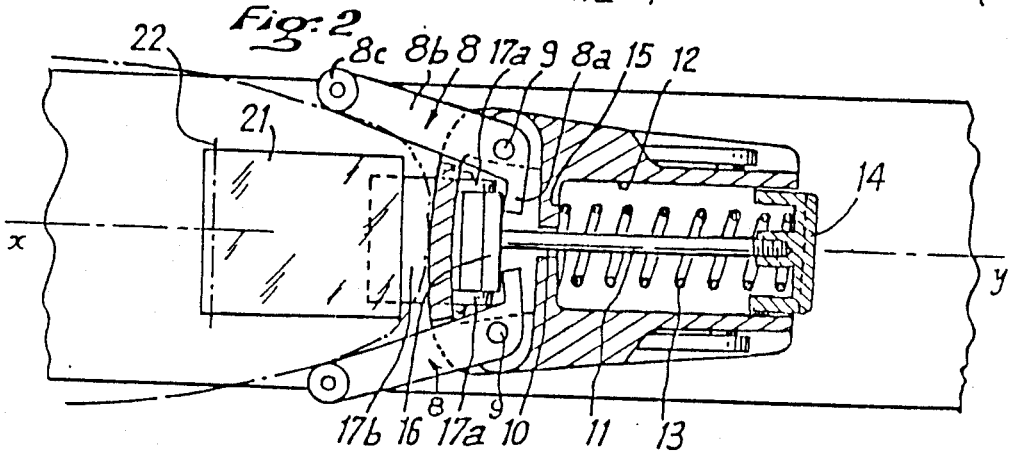
FIG. 2 is a horizontal cross-sectional view along line II—II of FIG. 1.
Figure 3:
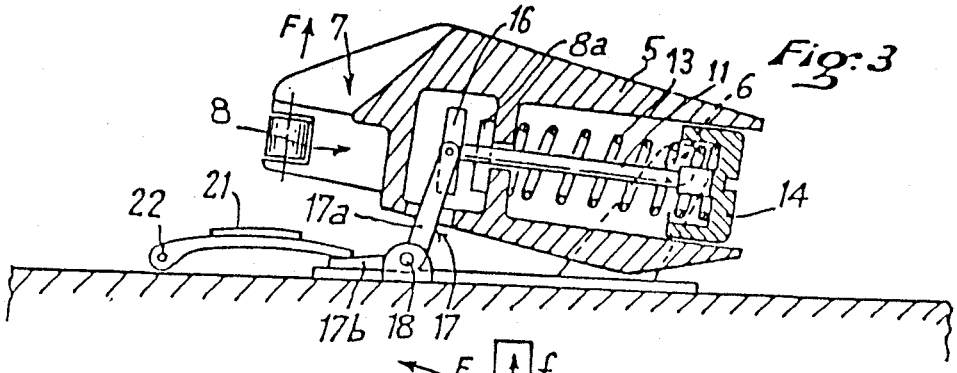
FIG. 3 is a vertical and longitudinal cross-sectional view of the front abutment of FIG. 1 whose body is shown pivoted upwardly due to a vertical bias caused by a rearward fall of the skier.

FIGS. 1–3 illustrate a safety binding 1 which is mounted on a ski 2 and which is adapted to retain the front end of a ski boot 3 shown in dashed lines. The front of the boot behind the end can be supported on a member fixed to the upper ski surface to thereby space the lower surface of the sole of the boot from the upper surface of the ski, as shown. This safety binding, or "front abutment", includes a base 4 affixed to the ski and on which a body 5 is pivotably mounted at its front portion around a substantially horizontal and transverse axis 6. The body 5 includes at its rear portion a retention jaw 7 formed of two lateral retention wings 8, each of which is journalled on body 5 around a substantially vertical axis 9. Each journalled wing 8 has portions which extend from each other at an obtuse angle. Each wing includes a front arm **8*a* having a relatively short length, extending in a direction transverse to the longitudinal axis of symmetry xy of the binding, and a rear arm 8*b*, inclined from the interior towards the exterior and from front to rear, and which ends in a roller 8c rotatably mounted around a substantially vertical axis. The wings 8 are adapted to ensure the lateral retention of boot 3** against torsional forces of the leg of the skier and, likewise, the vertical retention of the sole.

The energization mechanism of the front abutment 1 includes a longitudinal rod 11 which extends in a longitudinal bore 12 in body 5 in which a compression spring 13 is positioned. This compression spring 13 is supported at its front end on a cap 14 which is affixed to the front end of rod 11 and which can slide in bore 12. Cap 14 is screwed in an adjustable manner on rod 11 to adjust the compression force of spring 13 and, consequently, the stiffness of the binding. The rod 11 extends toward the rear and passes through a hole 10 bored at the center of a wall 15 of the body defining the end of bore 12, against which compression spring 13 is supported. The rod 11 is thus slidably guided along the direction in which it extends. At its rear end the rod 11 is affixed to a head 16 having an enlarged width or diameter, against which each of the lateral retention wings 8 acts through its respective front arm 8a, which is engaged in the space between head 16 of rod 11 and wall 15 of body 5 in which the hole 10 is bored. Arm 8a of wing 8 is simply supported on the front surface of head 16.

In this manner during a pure lateral bias, the rear arm 8b of the spring-biased lateral retention wing 8 is pushed towards the exterior of the ski, and pivots around its axis 9 and its front arm 8a, thus biasing head 16 of rod 11 in a manner so as to move it rearwardly against the energy of spring 13. When the intensity of the lateral bias exceeds a release threshold value depending upon the compression force of spring 13, the sole of the boot pushes wings 8 sufficiently towards the exterior so as to be able to escape the binding. The binding thereby releases the boot.

According to the invention, the front abutment 1 includes, beneath the rear portion of body 5 where head 16 of rod 11 and jaw 7 are located, a rocker 17 which is pivotably mounted on base 4 around a lower substantially horizontal and transverse axis 18. Rocker 17 includes a front portion in the form of a cap constituted by two arms 17a which are inclined from bottom to top and from rear to front. The upper ends of the two arms 17a are connected to the rear head 16 of rod 11 by means of a substantially horizontal and transverse journal axis 19. Consequently, in this embodiment, the journal axis 19 between rocker 17 and head 16 of rod 11 is positioned in a vertical plane between the vertical planes containing, respectively, the front journal axis of the rocker body 5 and the journal axis 18 of rocker 17 on base 4.

Rocker 17 likewise includes a rear activation flap 17b extending towards the rear and which is horizontal or slightly inclined from bottom to top and front to rear in the rest, or engagement position, of the binding. On the activation flap 17b rests the front end of a pedal 21, forming a frontward fall sensor which is journalled, at its rear end, around a substantially horizontal and transverse axis 22, and upon which the sole of the boot is supported.

In the case of a purely rearward fall of the skier, in which the front of the boot rises from the ski, the front of the boot lifts jaw 7 of body 5, by exerting on the jaw a force F which is upwardly directed, as is shown in FIG. 3. Body 5 thus pivots in its entirety clockwise around its front transverse axis 6 and rod 11 accompanies this rocking movement. As a result, the journal axis 19, between the rear head 16 of rod 11 and rocker 17, is lifted. Since the rocker is journalled around fixed axis 18, this lifting movement of axis 19 likewise results in a displacement of axis 19 towards the rear. Further, limited lateral displacement of the boot can be effected free from any bias imposed by spring 13 on such displacement. In effect, a portion of the work absorbed by the additional compression of spring 13 is performed by the lifting movement of the front of the boot. Otherwise stated, rod 11 is pulled towards the rear and spring 13 is further compressed, which diminishes, as well, the energy necessary for an ultimate lateral release.

In the case of a rearward fall combined with a torsional movement of the leg, the bias of the rod 11 towards the rear resulting from the rearward fall contributes to a reduction in the stiffness of the front abutment with respect to the lateral bias on one of wings 8. Otherwise stated, the release of the binding occurs for a lateral force of lesser intensity than the lateral release threshold which exists in the case of a bias which is purely torsional.

In the case of a frontward fall, in which the rear of the boot rises from the ski, the boot of the skier exerts on pedal 21 a vertical force F1 (FIG. 4) directed towards the ski. Pedal 21 thus causes a pivoting of rocker 17 in the counterclockwise direction around its journal axis 18 which results because of the connection established by the journal axis 19 in a movement of the rod 11 towards the rear. This movement of rod 11 towards the rear thus causes, as previously stated, a lifting of the journal axis 19, which results in a pivoting of body 5 upwardly, and a relative release of the wings of jaw 7. This movement likewise causes a reduction in the stiffness of the binding which is taken advantage of, if a torsional bias is associated with the frontward fall, to lower the lateral release threshold of the binding.

Figure 4:
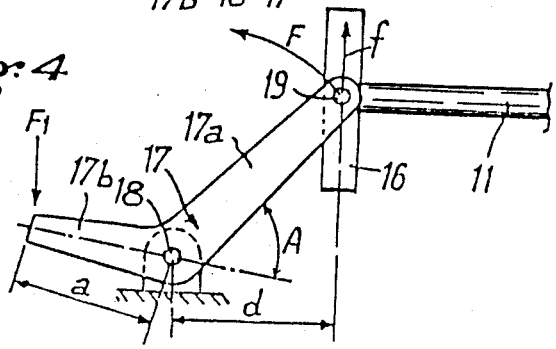
FIG. 4 is an elevational partial schematic view illustrating the role of the rocker of the front abutment of FIGS. 1–3, in a case of a frontward fall of the skier.

FIG. 4 illustrates in a detailed manner the role played by rocker 17 in the case of a frontward fall. The rear flap 17b of rocker 17 is subjected to the force F1 directed towards the ski and this translates into an upwardly directed force f, for a given force F1, which is transmitted through the upper end of arms 17a of the cap, to head 16. The intensity of this force f causing the reduction in the stiffness of the binding, depends on the length a of activation flap 17b and of the angle A between this flap and arms 17a. These two values can be carefully selected in a manner so as to obtain front abutments which provide reduction intensities f which are variable depending upon the ability level of individual skiers.

Figure 5:
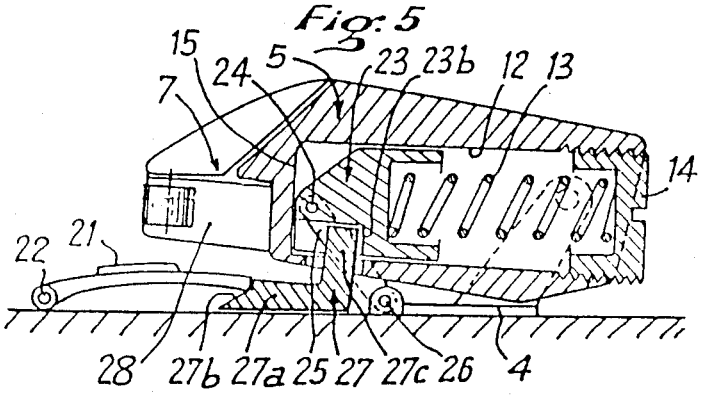
FIG. 5 is a vertical and longitudinal cross-sectional view of an alternative embodiment of the front abutment according to the invention.
Figure 6:
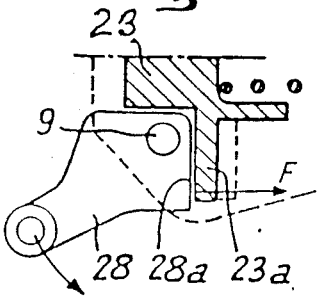
FIG. 6 is a partial horizontal cross-sectional view of the front abutment of FIG. 5, illustrating the embodiment of a lateral retention wing.

In the embodiment of the invention shown in FIGS. 5 and 6, body 5 includes, instead of rod 11, a piston 23 which is slidably positioned within the longitudinal bore 12 of body 5 and which is pushed towards the end 15 of bore 12 by compression spring 13 which is supported, at its front end, on stiffness adjustment cap 14 which is, in this case, screwed into a tapped portion provided at the front end of bore 12. The rear end portion of piston 23 is connected, by means of a substantially horizontal and transverse journal axis 24, to the upper ends of links 25 which are inclined from bottom to top and front to rear. These links 25 are journalled at their lower ends on base 4 around a substantially horizontal and transverse axis 26. Consequently, in this embodiment of the invention the lower journal axis 26 of the links is positioned in a vertical plane included between the vertical planes containing, respectively, the journal axis 24 of links 25 on piston 23 and journal axis 6 of pivoting body 5.

Each lateral wing 28 of jaw 7 is journalled on body 5 around a substantially vertical axis 9 and it is positioned in a manner so as to push piston 23 frontwardly, when it is biased towards the exterior in the case of a lateral bias, as can be seen in FIG. 6. To this end, each wing 28 has a front transverse surface 28*a* which is in contact with a transverse projection 23*a* of piston 23, in a manner so as to push projection 23*a* and, consequently, piston 23 frontwardly, when wing 28 is itself pushed towards the exterior of the ski.

The front abutment shown in FIGS. 5 and 6 likewise includes a pusher 27 substantially in the form of a square, which is mounted slidably longitudinal movable, under the rear portion of body 5. This pusher 27 includes a substantially horizontal arm 27*a* extending towards the rear and ending in a rear surface 27*b* forming a ramp, which is inclined from bottom to top and rear to front. This ramp 27*b* supports the front end of pedal 21 which forms a frontward fall sensor. Pusher 27 includes in its front portion a substantially vertical arm 27*c* which extends upwardly and which engages in an opening provided in the lower portion of piston 23, by being in contact, through the upper portion of its front surface, with a rear substantially vertical surface 23*b* of piston 23.

During a rearward fall, body 5 pivots in the clockwise direction around the front axis 6 and, as a result of the rigid connection established by links 25 between the fixed journal axis 26 and the upper journal axis 24 on piston 23, upper journal axis 24, which is lifted simultaneously with body 5, causes a displacement of piston 23 towards the front and an additional compression of the energization spring 13. If the rearward fall is combined with a lateral bias, the stiffness of the binding is then reduced because the transverse projection 23*a* of piston 23 is biased towards the front and tends to move away from the front surface 28*a* of each wing 28.

In the case of a frontward fall, the pedal sensor 21, on which the front of the boot rests, slides through its front end on the inclined ramp 27*b*, which causes a movement of pusher 27 towards the front. Pusher 27 moves piston 23 towards the front through substantially vertical arm 27*c*, which results in an additional compression of the energy spring 13 and a softening of the stiffness of the binding with respect to a lateral bias. The displacement of piston 23 towards the front likewise causes an elevation of the journal axis 24 in such a way that body 5 pivots clockwise, which ensures a slight opening of jaw 7 of body 5 towards the top and, consequently, a reduction of friction of this jaw on the edge of the sole.

Figure 7:
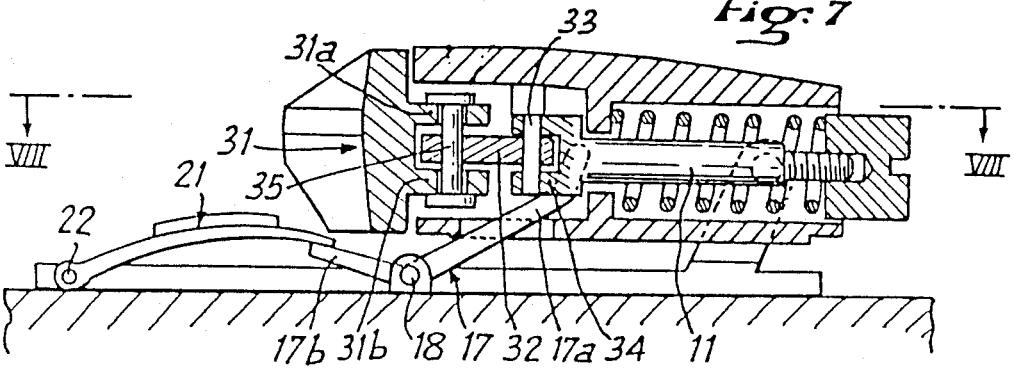
FIG. 7 is a vertical and longitudinal cross-sectional view of another embodiment of the front abutment according to the invention, the jaw of this abutment being made out of a single piece.
Figure 8:
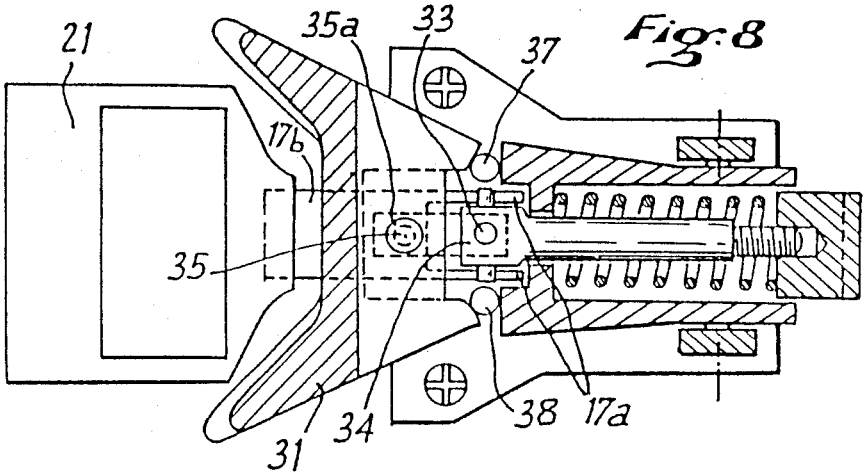
FIG. 8 is a horizontal cross-sectional view along line VIII—VIII of FIG. 7.
Figure 9:
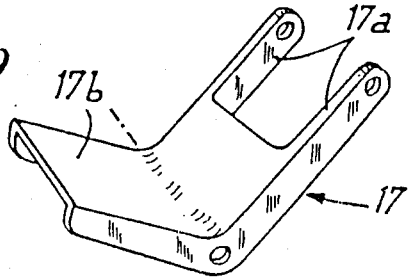
FIG. 9 is a perspective view of a rocker utilized in the front abutment according to the invention.

FIGS. 7, 8 and 9 illustrate the application of the invention to a front abutment of the type having rod 11, as is illustrated in FIGS. 1–3, but including a single piece jaw 31 including a central portion forming a sole-grip and two lateral wings thus ultimately also ensuring the vertical retention forming a single element. This single piece jaw 31 is connected to the rear end of rod 11 by means of a connecting link 32 which is substantially longitudinal and horizontal, which is journalled at its front end, around a substantially vertical axis 33, on the rear head 34 of rod 11, this head having the shape of a cap having substantially parallel and horizontal wings carrying the journal axis 33 and between which the connecting link 32 is engaged. At its rear end, the connecting link 32 is engaged substantially horizontally between upper wing 31*a* and lower wing 31*b*, substantially horizontal and parallel, forming an integral portion of single piece jaw 31 and extending frontwardly. The connection with jaw 31 is achieved by a substantially vertical axis 35.

As can be seen in FIG. 8, at rest jaw 31 which is pulled frontwardly is supported, through its front surface, on two substantially vertical axes 37 and 38 carried by body 5 of the front abutment, and pivots on one or the other of these substantially vertical axes 37 and 38 when they are laterally biased. As in the case of the embodiment shown in FIGS. 1–3, the rear head 34 of rod 11 is connected to portion 17*a* in the form of a cap for rocker 17 whose rear flap 17*b* is activated by pedal 21 so as to form a sensor for frontward fall, and rod 11 is slidably guided along the direction which it defines.

Figure 10:
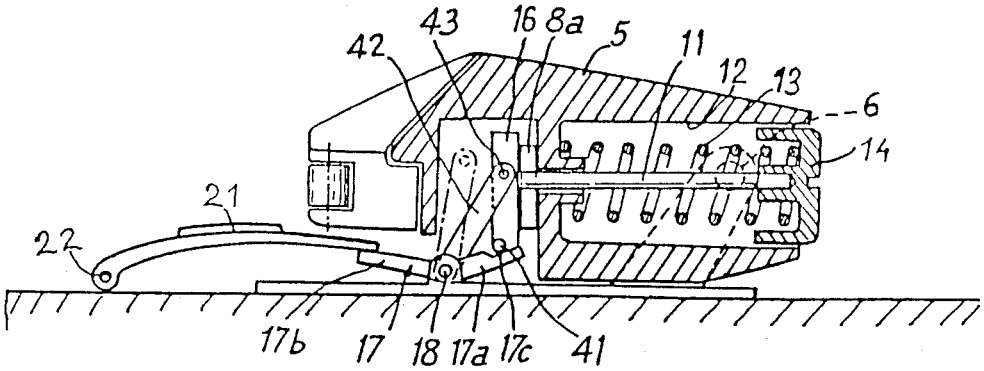
FIGS. 10 and 11 are vertical longitudinal cross-sectional views of other embodiments of the abutment according to the invention.

In the embodiment of the invention shown in FIG. 10, the front abutment is of the type having a rod 11 which is longitudinally slidably as is shown in FIGS. 1–3, but the front cap constituted by two arms 17*a* of rocker 17 is coupled to head 16 of rod 11 by means of a one-way connection apparatus and not by a two-way transverse journal axis, such as axis 19. To this end, each front arm 17*a* of rocker 17 is shaped, at its front and upper end in a manner so as to present a ramp 17*c* which is in contact from the bottom with a spur 41 which is affixed to head 16 of rod 11. Furthermore, a rigid linkage is established between the journal axis 18 of rocker 17 and head 16 of rod 11 by means of an independent link 42 which is journalled at its lower end around axis 18 and, at its upper end, around an axis 43 carried by head 16. Link 42 consequently forces rocking body 5 to lift as soon as rod 11 is biased towards the rear. In the case of a frontward fall in particular, rocker 17 pivots in the counterclockwise direction around its axis 18, as in the preceding cases, and ramp 17*c* of each front arm 17*a* of rocker 17 pushes spur 41 towards the rear and consequently rod 11 as well. The link 42 accompanies this movement by pivoting in the counterclockwise direction around axis 18. As a result, since the vertical plane passing through the upper journal axis 43 of link 42 on head 16 is between the vertical planes passing through the journal axes 6 and 18, the upper journal axis 43 is lifted, which causes a corresponding lifting of body 5. The shape of ramp 17*c* makes it possible to predetermine the lessening effect caused by pedal 21 by causing, for a single angular displacement of rocker 17, a rather substantial rearward displacement of rod 11. The operation of the embodiment of FIG. 10 for rearward falls is substantially the same as that described above in other embodiments.

Figure 11:
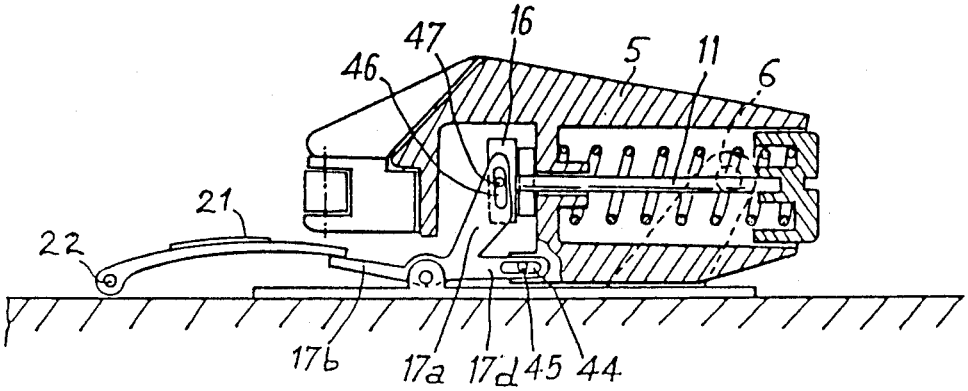

In the embodiment of the invention shown in FIG. 11, rocker 17 includes in front, on each side, an additional horizontal arm 17*d* in which a longitudinal slot 44 is formed. In this slot, a spur 45 which is affixed to the lower portion of rocker body 5 projects. Furthermore, each arm 17*a* which is inclined upwardly has, at its upper end portion, a substantially vertical slot 46 within which a spur 47 is engaged which is affixed to head 16 of rod 11. In the case of a frontward fall, pedal 21 causes, as previously mentioned, the pivoting of rocker 17 in the counterclockwise direction around transverse journal axis 18. The front substantially horizontal arm 17*d* of rocker 17 thus causes, by virtue of the engagement of spur 45 in slot 44, the lifting of body 5 which pivots around its transverse axis 6 in the clockwise direction. Furthermore, the inclined arm 17*a* causes, as a result of the engagement of spur 47 in slot 46, a displacement of head 16 and, consequently, of rod 11 towards the rear, which causes a reduction of the stiffness of the binding. In the case of a rearward fall, body 5 is lifted by rocking in the clockwise direction around its axis 6 and it then causes, as a result of the engagement of its spur 45 in slot 44 of horizontal arm 17*b*, the pivoting of rocker 17 in the counterclockwise direction. By virtue of the corresponding pivoting of the inclined arm 17*a*, this arm causes a displacement of rod 11 towards the rear, as a result of the connection achieved by spur 47 engaged in slot 46.

Although the invention has been described with reference to particular means, embodiments and details, it is to be understood that the invention is not limited to the particulars disclosed, but extends to all equivalents within the scope of the claims.

I claim:

1. Safety binding for releasably maintaining a front portion of a boot mounted on a ski, comprising a body mounted on a base affixed to said ski, said body comprising a retention jaw in a rear portion thereof, said retention jaw comprising a sole-grip and two opposed lateral retention wings and having an engagement position, and an energization mechanism positioned in said body to elastically return said jaw to said engagement position upon movement away from said engagement position, said energization mechanism comprising an energy spring supported, at one end, on a support surface connected to said body and, at another end, on a force transmission element which is movable for longitudinal displacement in said body and coupled to said jaw in a manner so as to elastically bias said jaw against said front portion of said boot, to ensure the retention of said boot on said ski, wherein said body is pivotably mounted on said base in a front portion of said base around a first substantially horizontal and transverse axis, and wherein said force transmission element which is coupled to said jaw is connected to an upper end of a rigid linkage element which is journalled at its lower end on said ski around a second substantially horizontal and transverse axis and which is arranged in a manner such that a rocking movement of said body upwardly, around said first substantially horizontal and transverse axis translates into a displacement of said force transmission element in a direction corresponding to an additional bias of said energy spring, and a displacement of said force transmission element in said body translates into a rocking movement of said body.

2. Safety binding or a ski according to claim 1 in which said spring is a compression spring, and said force transmission element includes a longitudinal rod which is biased fronwardly by said energy spring supported, on the one hand, on a rear traverse end of an opening of said body containing said spring and, on the other hand, on a cap fixed to a front end of said rod, wherein said upper end of said linkage element is connected at a linkage axis to a head of said rod and is inclined, in said engagement position, from bottom to top and rear to front such that said linkage axis for linkage with said head of said rod is positioned in a substantially vertical plane between vertical planes containing, respectively, said second transverse axis of said linkage element on said base and said first transverse axis of said body on said base.

3. Safety binding for a ski according to claim 2 wherein said jaw comprises two lateral retention wings which are respectively journalled on said body around vertical axes, each lateral retention wing having portions substantially forming an obtuse angle and comprising a front arm of relatively short length, for contacting a front surface of said head of said rod, and a rear arm laterally inclined from the interior towards the exterior and from the front towards the rear.

4. Safety binding for a ski according to claim 2 wherein said linkage element is constituted by a rocker having a front portion with two arms, said two arms being inclined from bottom to top and rear to front and being connected to said head of said rod.

5. Safety binding for a ski according to claim 4 wherein said upper portions of said two arms of said rocker are connected to said head of said rod through a substantially horizontal and transverse journal axis.

6. Safety binding for a ski according to claim 5 wherein said rocker comprises an activation flap extending towards the rear and which is horizontal or slightly inclined from bottom to top and from front to rear in a rest position, and on said activation flap rests the front end of a pedal said pedal, forming a frontward fall sensor, which is journalled around a third substantially horizontal and transverse axis.

7. A binding for releasably securing an end of a skier to a ski comprising:

means for engaging a portion of said end of said boot, wherein said engaging means is mounted for lateral movement from an engagement position to a release position in response to the application of a release threshold force of a predetermined magnitude laterally against said engaging means;

means responsive to either a frontward fall or a rearward fall of said skier for reducing said predetermined magnitude of said release threshold force required for moving said engaging means laterally to said release position, said fall responsive means including means for pivotally mounting said engaging means about a first axis at a forward portion thereof; and means for elastically biasing said engaging means toward said engagement position, said elastically biasing means providing a biasing force against which said application of a release threshold force acts to allow movement of said engaging means to said release position;

wherein said fall responsive means comprises means for transmitting movement of said boot to said elastically biasing means, such that the pivotal movement of said engaging means translates into a displacement of said means for transmitting movement to bias said elastically biasing means and a displacement of said means for transmitting movement causes pivotal movement of said engagement means.

8. The binding of claim 7 wherein said means for transmitting movement is movable from a first position to a second position corresponding, respectively, to said engagement position and said release position of said engaging means wherein, in said second position, said transmitting means transmits a force against said elastically biasing means at least equal to said release threshold force, and wherein, in response to only either said frontward fall or only said rearward fall, said transmitting means transmits a force against said elastically biasing means less than said release threshold force.

9. The binding of claim 8 further comprising means for permitting movement of said engaging means in a direction away from said ski, wherein said transmitting means transmits a force against said elastically biasing means less than said release threshold force in response to movement of said engaging means in a direction away from said ski.

10. The binding of claim 9 wherein said engaging means is movable in said direction away from said ski in response to movement of said boot.

11. The binding of claim 9 wherein said engaging means is movable in said direction away from said ski in response to movement of said end of said boot directly against said engaging means.

12. The binding of claim 9 wherein said engaging means is movable in said direction away from said ski in response to movement of said means for transmitting movement of said boot in a direction toward said ski.

13. The binding of claim 12 further comprising means for linking said movement of said end of said boot toward said ski to said transmitting means.

14. The binding of claim 8 wherein said binding is a front binding.

15. The binding of claim 8 wherein said engaging means comprises a jaw having a pair of arms that move relative to each other.

16. A binding for releasably securing an end of a boot of a skier to a ski comprising:

a body including means for engaging a portion of said end of said boot, wherein said engaging means is mounted for lateral movement from an engagement position to a release position in response to the application of a release threshold force of a predetermined magnitude laterally against said engaging means, and wherein said body is further mounted for movement in a direction substantially perpendicular to the direction of said lateral movement, said body being mounted for pivotal movement relative to the ski;

means for elastically biasing said engaging means toward said engagement position, against which said threshold force is applied to move said engaging means from said engagement position to said release position, said elastically biasing means being mounted in said body;

means responsive to lateral movement of said end of said boot for applying a force against said elastically biasing means and for compressing said elastically biasing means; and means responsive to non-lateral movement of said end of said boot for applying a force against said elastically biasing means for moving said elastically biasing means;

a force transmitting member operatively associated with said elastically biasing means and each of said lateral and non-lateral movement responsive means, such that a pivotal movement of said body translates into a displacement of said force transmitting member for applying said force against said elastically biasing means and a displacement of said force transmitting member causes pivotal movement of said body;

wherein for a given increment of movement of said elastically biasing means by said non-lateral movement of said end of said boot, the amount by which said lateral movement of said end of said boot is required for movement of said engaging means to said release position is reduced by a substantially corresponding increment.

17. The binding of claim 16 wherein said engaging means comprises a jaw having a pair of arms that are movable relative to each other.

18. The binding of claim 16 further comprising an axis substantially transverse to the longitudinal axis of said ski about which said body is mounted for the pivotal movement which is substantially perpendicular to said lateral movement.

19. The binding of claim 16 wherein said lateral movement responsive means is fixed for movement with said engaging means.

20. The binding of claim 19 wherein said engaging means comprises a jaw having a pair of arms, and wherein said lateral movement responsive means comprises a further arm connected to each respective arm for directly engaging a member fixed relative to said transmitting member.

21. The binding of claim 16 wherein said non-lateral movement responsive means includes means for directly engaging a member fixed relative to said transmitting member.

22. The binding of claim 21 wherein said directly engaging means comprises a rigid linkage element journalled at one end relative to said transmitting member, and journalled at another end about an axis adapted to be fixed relative to said ski.

23. The binding of claim 22 wherein said linkage element is connected to said transmitting member to apply a force to said transmitting member in response to movement of said end of said boot toward and away from said ski.

* * * * *